US005582328A

United States Patent [19]

Brown

[11] Patent Number: 5,582,328

[45] Date of Patent: Dec. 10, 1996

[54] CONTAINER FOR TOILETRIES, PERSONAL HYGIENE PRODUCTS AND ARTICLES

[76] Inventor: Saundria L. Brown, 34 Benshire Drive, Scarborough, Ontario, Canada, M1H 1M2

[21] Appl. No.: 292,028

[22] Filed: Aug. 18, 1994

[30] Foreign Application Priority Data

Apr. 14, 1994 [CA] Canada ..... 2128033

[51] Int. Cl.[6] ..... B67D 5/38

[52] U.S. Cl. ..... 222/23; 222/107

[58] Field of Search ..... 222/92, 106, 107, 222/23, 158, 154; 215/230; 428/916; 206/807; 116/217

[56] References Cited

U.S. PATENT DOCUMENTS

| | | | |
|---|---|---|---|
| 2,330,149 | 9/1943 | Schaaff | 222/158 |
| 2,682,974 | 7/1954 | Smith | 222/107 |
| 2,764,829 | 10/1956 | Kingman | 222/92 |
| 3,777,697 | 12/1973 | Voessner | 222/23 |
| 4,473,097 | 9/1984 | Knickerbocker et al. | 222/158 |
| 4,733,786 | 3/1988 | Emslander | 215/230 |
| 4,863,014 | 9/1989 | Summons et al. | 222/158 |

*Primary Examiner*—Andres Kashnikow
*Assistant Examiner*—Philippe Derakshani
*Attorney, Agent, or Firm*—Cushman Darby & Cushman, L.L.P.

[57] ABSTRACT

A container for toiletries, personal hygiene products and articles, said container comprising a body formed of a sealable, preferable heat-sealable material for storing said product or article and having a first portion defining a sealed aperture through which aperture said product or article was added to said body; a second portion defining an aperture through which said product is operatively dispensed from said body; an outer surface adjacent said first portion; and identification means associated with said outer surface such that opening of said body at or adjacent said first portion to provide a third aperture and subsequent sealing of said third aperture effects a visual change in said identification means. The containers are so adapted as to enable, through visual inspection, whether the container has been unsealed and refilled with undesirable materials or articles such as drugs or sharp objects by patients, residents or inmates of detention or correctional institutions. The invention provides containers adapted to be visually inspected to detect tampering of the container.

13 Claims, 2 Drawing Sheets

CONTAINER FOR TOILETRIES, PERSONAL HYGIENE PRODUCTS AND ARTICLES

FIELD OF THE INVENTION

This invention relates to packaging for materials and articles such as personal hygiene products, cosmetics and the like and particularly packaging in the form of tubes, pouches and sachets formed of a thermoplastics material; and more particularly to such packaged materials and articles for dispensation to patients, residents, inmates and the like of detention institutions such as hospitals and prisons.

BACKGROUND TO THE INVENTION

Personal hygiene products, cosmetics, toiletries, health and beauty aids such as toothpaste, shampoos, body lotions, deodorants, soaps, hairspray, cosmetics in the form of dispensable foams, gels, liquids, emulsions and the like and articles such as sanitary napkins, razors, combs, toothbrushes and the like are typically packaged for retail purposes in thermoplastic deformable containers such as cylindrical tubes, pouches, sachets and the like. Such products and articles are either dispensed from the container by the cutting of the plastics material or by the unscrewing of a cap, operation of a plunger, through a nozzle, or other aperture.

Typically, such packaged ingredients and articles are commercially available to the public through retail stores such as supermarkets and drugstores, or vending machines. Generally, safety or other features associated with the packaging are designed invariably to prevent accidental or unintended dispensation of the ingredients. For example, the containers may have tamper proof caps to prevent unwanted dispensation of the product by a child.

In the case of patients, residents, inmates and the like of detention or correctional institutions, such personal hygiene products and cosmetics are provided to the patients and residents in the same ordinary commercial containers as available to members of the public. Although these articles may be dispensed to both male and female supervised patients, residents and inmates, typically from a central institutional authority no special containers are provided to such inmates, residents and patients.

Often, certain of the above described commercially available containers are capable of being surreptitiously opened and partly or wholly refilled with illegal substances, such as drugs or articles, such as razor blades or sharpened objects capable of causing physical injury. The ingenuity of institutionalized inmates, residents and patients is renowned. Thus, many containers and packaging of the type referred to hereinabove may be used when empty by an inmate or patient to provide a container capable of hiding improper substances or articles in place of the proper material, to escape detection and confiscation thereof by the institutional authorities.

Accordingly, there is a need to provide personal hygiene products, cosmetics and the like in containers such that the institutional authorities can readily detect any tampering of the container by a rapid, visual inspection in order to reduce the risk of subsequent use of any illicit substance or weapon hidden in the container.

SUMMARY OF THE INVENTION

It is an object of the present invention to provide a container for personal hygiene products, cosmetics and the like, intrinsically adaptable to the containment of illicit substances and dangerous weapons, but which container is adapted to readily enable through visible inspection to detect whether the container has been opened and re-sealed.

This and other objects of the invention will be readily seen from a reading of the specification as a whole.

Accordingly, in its broadest aspect, the invention provides a container for toiletries, personal hygiene products and articles, said container comprising a body formed of a sealable material for storing said product or article and having a first portion defining a sealed aperture through which aperture said product or article was added to said body; a second portion defining an aperture through which said product is operatively dispensed from said body; an outer surface adjacent said first portion; and identification means associated with said outer surface such that opening of said body at or adjacent said first portion to provide a third aperture and subsequent sealing of said third aperture effects a visual change in said identification means.

The container may be of any shape suitable as a container for the stated ingredients and articles, provided it has the inventive features herein defined. It may be formed in whole or in part of any heat-sealable material, preferably, a resiliently flexible thermoplastics material, for example, a thermoplastic material such as a polymer or copolymer of ethylene, propylene, polyethylene teraphthalate and polyvinyl chloride.

The identification means, preferably, further functions as dimension identification means, which enables a change in a dimension such as a length or breadth of the container to be detected where such a change in dimension is caused by the opening and re-sealing, preferably by heat, of the container.

The identification means, preferably, comprises a plurality of identification features selected from the group consisting of marks, numerals, letters, symbols, colours and designs, so arranged as to constitute a visual preselected pattern.

BRIEF DESCRIPTION OF THE DRAWINGS

In order that the invention may be better understood, preferred embodiments will now be described by way of example only with reference to the accompanying drawings wherein.

DETAILED DESCRIPTION OF PREFERRED EMBODIMENTS

Figure 1:
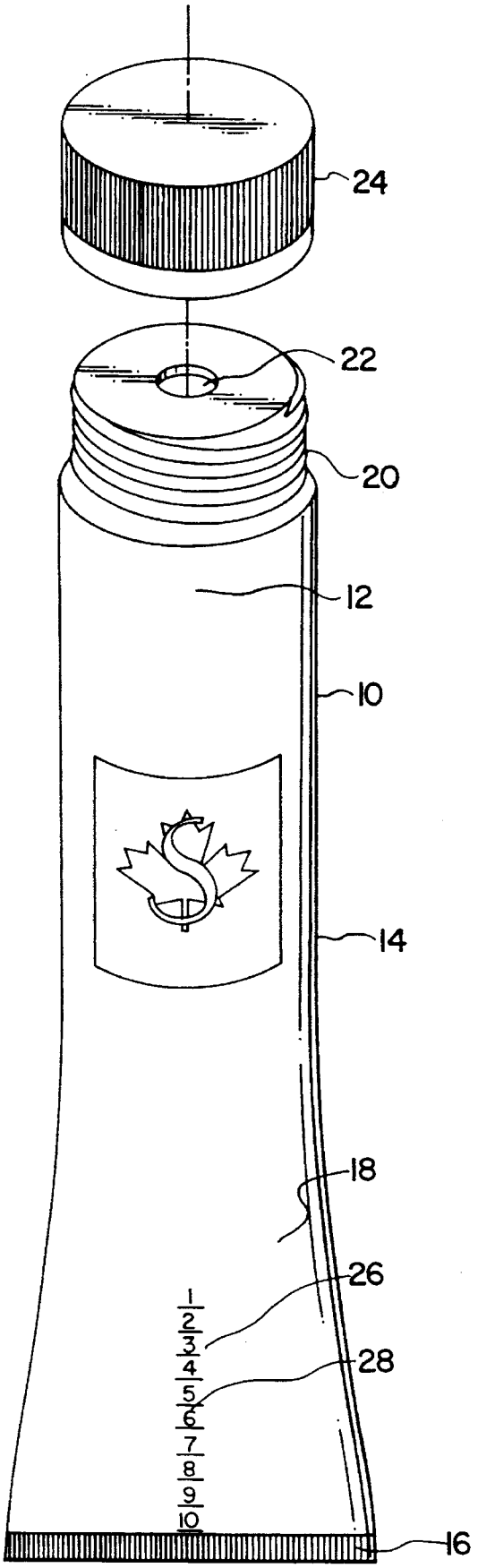
FIG. 1 represents a diagrammatic perspective view of a container according to the invention.

With reference to FIG. 1 which represents a container, formed of a polyethylene, shown generally as 10, holding a shampoo, gel or the like 12, having a cylindrical or tubular body portion 14. Container 10, at one end has a portion 16 defining a sealed aperture through which aperture prior to sealing was added personal body care ingredients 12 during manufacture. Sealing of aperture portion 16 provides body 14 with a tapered portion 18, adjacent sealed aperture 16.

Container 10 has a screw neck 20, provided with product outlet aperture 22 closed by screw cap 24.

Adhered to and adjacent tapered portion 18, is a label 26 bearing a plurality of identification numerals 28, which, in this embodiment, range from 1–10 extending from sealed aperture portion 16 lengthwise of tube 14.

Figure 2:
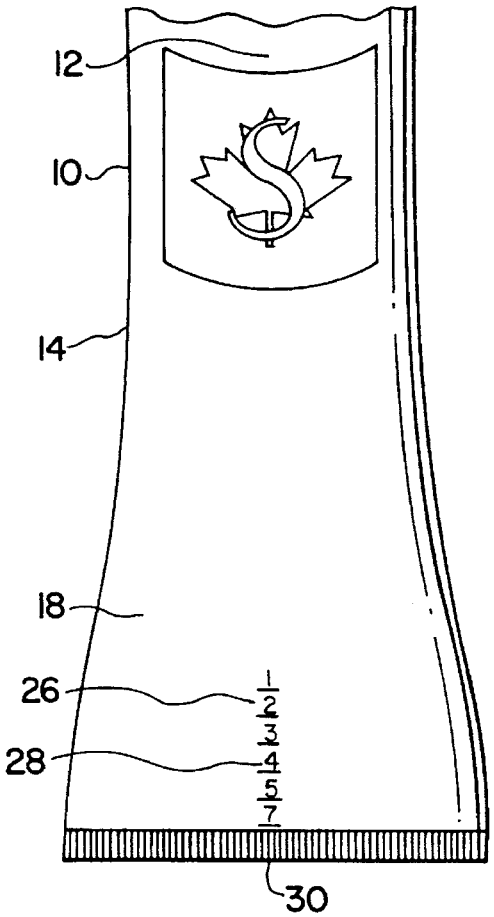
FIG. 2 represents, in part, a diagrammatic perspective view of the container of FIG. 1, of reduced length.

Thus, the identification numerals 28 are so located and arranged that if container 10 is opened by the cutting or otherwise of or adjacent to sealed aperture 16, say, for the purpose of the insertion of illicit substances or articles after the total or partial removal of the original ingredients, followed by subsequent heat-sealing of the thermoplastics material to effect a reseated aperture 30 (FIG. 2), either some or all of the numerals of label 26 are destroyed or otherwise obliterated. Such a change to the identification numerals enables, by visual inspection, the detection of any disturbance of sealed aperture 16. The identification label is so arranged as to detect any change in the length of the tube or other disturbance of the seal. It is, thus, possible to detect a change in length of container 10 possibly due to the cutting and/or resealing of container 10.

Figure 3:
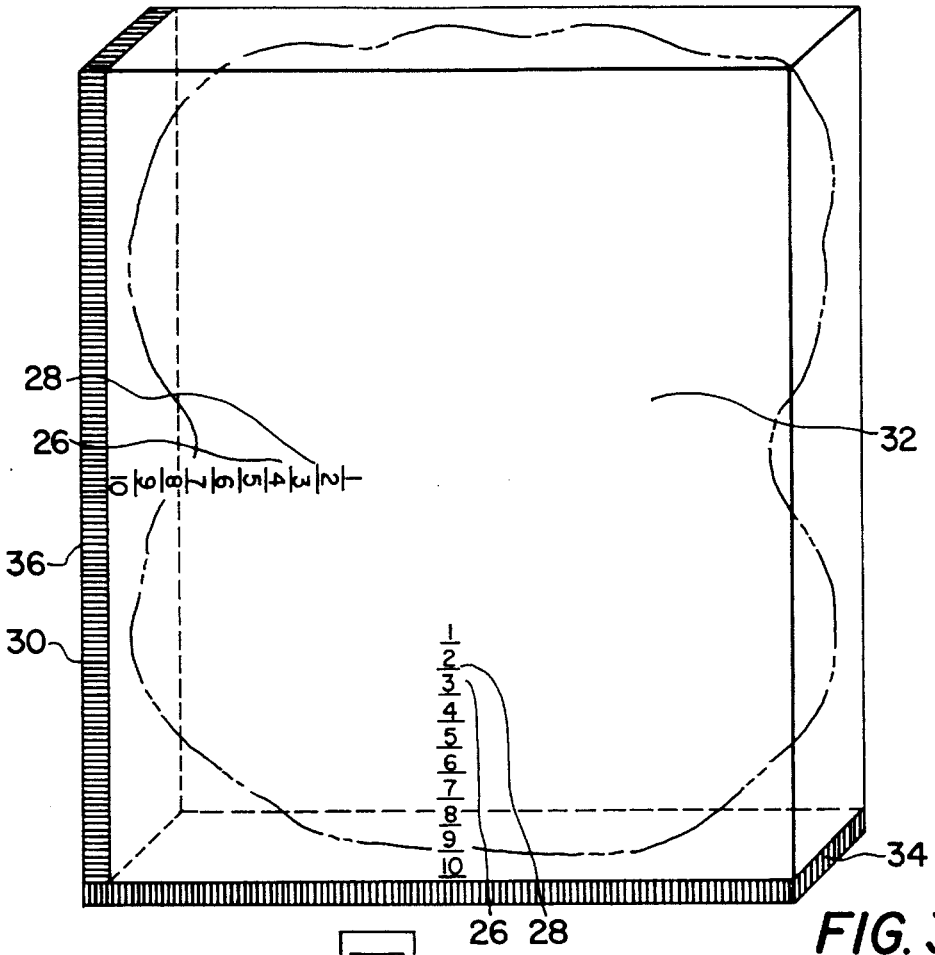
FIG. 3 represents an further embodiment of a container according to the invention containing a shower cap.

FIG. 3 shows a substantially rectangularly shaped container 30 formed of polyethylene such as a pouch or sachet containing a shampoo cap 32. Labels 26 having identification numerals 28 are adjacent each of edges 34, 36 which can be seen to have been sealed during manufacture. If there are more than one of such presealed edges, sufficient labels and identification numeral sequences must be employed. In those cases where the sealing of an edge during manufacture is such as to provide a seal not so detectable upon a quick visual inspection, then, clearly, no identification sequence is necessary since an opening or cut and subsequent resealing of such an edge should be readily detectable by visual inspection, obviating the need for additional identification means.

Figure 4A:
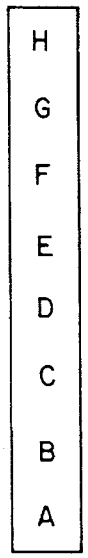
FIGS. 4A–4D represents enlarged diagrammatic views of identification means on a label of use on a container according to the invention; and wherein the same numeral denotes like parts throughout the drawings.
Figure 4B:
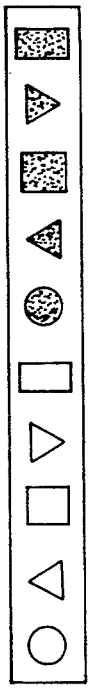
Figure 4C:
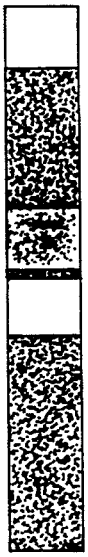
Figure 4D:
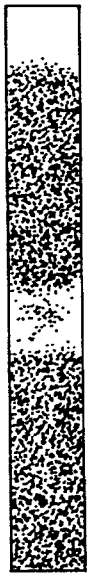

FIGS. 4A–4B represent examples of identification means such as in FIG. 4A—letters in alphabetical order; FIG. 4B—symbols in a preselected recognizable sequence; FIG. 4C—colour sequence depicted either as discreet units of difference colours or as in FIG. 4D a continuum as in colours of the rainbow.

In a further embodiment, the identification numerals 28 may be integrally formed within the thermoplastics material at portion 18; or painted thereon or applied in some other suitable manner.

In a yet further embodiment, the heat-sealable material may comprise a heat-sensitive material which changes colour when heated, particularly to the melting point of the heat-sealable material of the container. Such a colour change would enable rapid visual inspection to detect the improper opening and resealing thereof.

While this disclosure has described in detail and with reference to preferred embodiments thereof, it will be apparent to one skilled in the art that various changes and modifications can be made therein without departing from the spirit and scope thereof.

I claim:

1. A container for toiletries, personal hygiene products and articles, said container comprising a body formed of a sealable material for storing said product or article and having a first portion defining a sealed aperture through which aperture said product or article was added to said body; a second portion defining an aperture through which said product is operatively dispensed from said body; an outer surface adjacent said first portion; and identification means associated with said outer surface such that opening of said body at or adjacent said first portion to provide a third aperture and subsequent sealing of said third aperture effects a visual change in said identification means such that visual inspection enables the detection of inappropriate opening and sealing of said third aperture.

2. A container as claimed in claim 1 wherein said sealable material is heat-sealable.

3. A container as claimed in claim 1 wherein said sealable material is a heat sealable thermoplastics material.

4. A container as claimed in claim 1 wherein said body comprises a tubular central portion and an integrally formed tapered portion adjacent said first portion.

5. A container as claimed in claim 3 wherein said thermoplastic material is selected from the group consisting of a polymer or copolymer of ethylene, propylene, polyethylene teraphthalate and polyvinyl chloride.

6. A contained as claimed in claim 1 wherein said identification means comprises a plurality of identification features selected from the group consisting of marks, numerals, letters, symbols, colours and designs, so arranged as to constitute a visual pre-selected pattern.

7. A container as claimed in claim 6 wherein said identification means comprises a plurality of numerals in a recognizable order or sequence.

8. A container as claimed in claim 6 wherein said identification means comprises letters of the alphabet in a pre-selected sequence.

9. A container as claimed in claim 1 wherein said identification means is integrally formed with said body.

10. A container as claimed in claim 1 wherein said identification means comprises a label bearing identification features.

11. A container as claimed in claim 3 wherein said thermoplastic material comprises a heat-sensitive material.

12. A container as claimed in claim 11 wherein said heat-sensitive material is colour changeable when heated.

13. A container as claimed in claim 1 containing toiletries, personal hygiene products and articles.

* * * * *